US011316267B2

(12) United States Patent
Kaistha et al.

(10) Patent No.: US 11,316,267 B2
(45) Date of Patent: Apr. 26, 2022

(54) DEVICES AND METHODS FOR MITIGATING EXTERNAL PASSIVE INTERMODULATION SOURCES IN BASE STATION ANTENNAS

(71) Applicant: CommScope Technologies LLC, Hickory, NC (US)

(72) Inventors: Amit Kaistha, Coppell, TX (US); John Chamberlain, Hickory, NC (US); Maureen Ho, Murphy, TX (US); Michel Dembinski, Dallas, TX (US)

(73) Assignee: CommScope Technologies LLC, Hickory, NC (US)

( * ) Notice: Subject to any disclaimer, the term of this patent is extended or adjusted under 35 U.S.C. 154(b) by 21 days.

(21) Appl. No.: 16/675,686

(22) Filed: Nov. 6, 2019

(65) Prior Publication Data

US 2020/0185827 A1 Jun. 11, 2020

Related U.S. Application Data

(60) Provisional application No. 62/873,415, filed on Jul. 12, 2019, provisional application No. 62/775,524, filed on Dec. 5, 2018.

(51) Int. Cl.

| | |
|---|---|
| ***H01Q 1/12*** | (2006.01) |
| ***H01Q 1/52*** | (2006.01) |
| ***H01Q 1/24*** | (2006.01) |

(52) U.S. Cl.

CPC ..... *H01Q 1/528* (2013.01); *H01Q 1/1228* (2013.01); *H01Q 1/1242* (2013.01); *H01Q 1/246* (2013.01)

(58) Field of Classification Search

CPC ..... H01Q 1/246; H01Q 1/1228; H01Q 1/42; H01Q 1/1242; H01Q 1/125; H01Q 3/08; H01Q 1/1235

(Continued)

(56) References Cited

U.S. PATENT DOCUMENTS 5,065,969 A * 11/1991 McLean ..... H01Q 3/04 248/282.1
5,870,059 A * 2/1999 Reynolds ..... H01Q 1/1242 343/760

(Continued)

OTHER PUBLICATIONS

Wolk et al., "AO-4025 ITT ESA—Surface Treatment and Coating for the Reduction of Multipactor and Passive Intermodulation (PIM) Effects in RF Components", 4th International Workshop on Multipactor, Corona and Passive Intermodulation in Space RF Hardware (MULCOPIM 2003) held in Noordwijk, The Netherlands, pp. 1-12.

*Primary Examiner* — Linh V Nguyen
(74) *Attorney, Agent, or Firm* — Myers Bigel, P.A.

(57) ABSTRACT

The present disclosure describes an antenna mount kit. The antenna mount kit includes an antenna mount and a pipe clamp coupled to the antenna mount. The pipe clamp includes a front shell half and a rear shell half, the front shell half and the rear shall half having a front shell half inner surface and a rear shell half inner surface configured to cooperate with each other such that the mounting structure can be secured within the pipe clamp, at least two threaded bolts, a plurality of washers, and a plurality of nuts. The antenna mount kit may further include at least two isolation fasteners. The front shell half inner surface and the rear shell half inner surface each include a plurality of jagged teeth formed of a non-metallic material, at least two front shell bolt apertures through the front shell half, and at least two rear shell half bolt apertures through the rear shell half. The front shell half bolt apertures align with the rear shell half bolt apertures when securing the mounting structure within the pipe clamp. Antenna mount assemblies and methods for reducing external passive intermodulation from an antenna mount kit are also provided.

11 Claims, 9 Drawing Sheets

(58) Field of Classification Search
USPC ..... 343/874
See application file for complete search history.

(56) References Cited

U.S. PATENT DOCUMENTS

| | | | | |
|---|---|---|---|---|
| 6,239,757 | B1 * | 5/2001 | Ishikawa | H01Q 13/28 343/711 |
| 6,283,425 | B1 * | 9/2001 | Liljevik | H01Q 1/125 248/218.4 |
| 6,559,806 | B1 * | 5/2003 | Watson | H01Q 1/125 343/758 |
| 6,809,702 | B2 * | 10/2004 | Safakhah | H01Q 1/1207 343/880 |
| 10,816,240 | B2 * | 10/2020 | Robinson | F24S 25/13 |
| 10,971,794 | B2 * | 4/2021 | Smith | H01Q 1/1242 |
| 2005/0057427 | A1 * | 3/2005 | Wensink | H01Q 1/125 343/878 |
| 2007/0052606 | A1 * | 3/2007 | Gold | H01Q 3/00 343/760 |
| 2009/0195467 | A1 * | 8/2009 | Vassilakis | H01Q 1/1228 343/765 |
| 2010/0231450 | A1 * | 9/2010 | Le Sage | H01Q 3/08 342/359 |
| 2011/0225804 | A1 * | 9/2011 | Clifford | H01Q 1/1207 29/593 |
| 2012/0138208 | A1 * | 6/2012 | Stanley | E04G 21/328 156/66 |
| 2015/0144758 | A1 * | 5/2015 | Kolokotronis | H01Q 1/1242 248/282.1 |
| 2017/0062901 | A1 * | 3/2017 | Owen | H01Q 1/1242 |

* cited by examiner

DEVICES AND METHODS FOR MITIGATING EXTERNAL PASSIVE INTERMODULATION SOURCES IN BASE STATION ANTENNAS

RELATED APPLICATIONS

The present application claims priority from and the benefit of U.S. Provisional Application Ser. No. 62/775,524, filed Dec. 5, 2018, and U.S. Provisional Application Ser. No. 62/873,415, filed Jul. 12, 2019, the disclosures of which are hereby incorporated herein in their entirety.

FIELD

The present application is directed generally toward telecommunications equipment, and more particularly antenna mounts, kits and assemblies for mitigating external passive intermodulation near an antenna.

BACKGROUND

Currently, there a variety of metallic (e.g., stainless steel) components that are used to secure antennas to telecommunications towers (e.g., antenna mounts). However, the use of metal components near an antenna on cell sites can be a source of unwanted passive intermodulation (PIM) in the modern radio frequency (RF) environment. As antenna systems have become more complex in the last few years along with the densification of cell towers, interaction of external noise has become a PIM source that impacts the network performance. While internal sources of PIM (e.g., within base station antennas) can be addressed by best design practices and reduction of unnecessary metal-to-metal contact, one area that can be improved upon is the metal-to-metal interface for the external antenna mount kits.

SUMMARY

A first aspect of the present invention is directed to an antenna mount kit. The antenna mount kit may include an antenna mount and a pipe clamp coupled to the antenna mount. The pipe clamp may include a front shell half and a rear shell half, the front shell half and the rear shall half having a front shell half inner surface and a rear shell half inner surface configured to cooperate with each other such that the mounting structure can be secured within the pipe clamp. The front shell half inner surface and the rear shell half inner surface may each include a plurality of jagged teeth formed of a non-metallic material, at least two front shell bolt apertures through the front shell half and at least two rear shell half bolt apertures through the rear shell half, where the front shell half bolt apertures align with the rear shell half bolt apertures when securing the mounting structure within the pipe clamp, at least two threaded bolts, a plurality of washers, and a plurality of nuts.

Another aspect of the present invention is directed to an antenna mount kit. The antenna mount kit may include a pipe clamp coupled to an antenna mount. The pipe clamp may include a front shell half and a rear shell half, the front shell half and the rear shall half having a front shell half inner surface and a rear shell half inner surface configured to cooperate with each other such that the mounting structure can be secured within the pipe clamp. The front shell half inner surface and the rear shell half inner surface may each include a plurality of jagged teeth formed of a non-metallic material, at least two front shell bolt apertures through the front shell half and at least two rear shell half bolt apertures through the rear shell half, where the front shell half bolt apertures align with the rear shell half bolt apertures when securing the mounting structure within the pipe clamp, at least two threaded bolts, a plurality of washers, and a plurality of nuts. The antenna mount may include a first mounting bracket configured to be mounted to the pipe clamp, a second mounting bracket configured to be mounted to an antenna and pivotally coupled to the first mounting bracket at a pivot. The pivot may include equally spaced apart phase holes configured to receive an adjustment bolt.

Another aspect of the present invention is directed to an antenna mount kit. The antenna mount kit may include an antenna mount and a pipe clamp coupled to the antenna mount. The pipe clamp may include a front shell half and a rear shell half, the front shell half and the rear shall half having a front shell half inner surface and a rear shell half inner surface configured to cooperate with each other such that the mounting structure can be secured within the pipe clamp. The front shell half inner surface and the rear shell half inner surface may each include a plurality of jagged teeth formed of a non-metallic material, at least two front shell bolt apertures through the front shell half and at least two rear shell half bolt apertures through the rear shell half, where the front shell half bolt apertures align with the rear shell half bolt apertures when securing the mounting structure within the pipe clamp, at least two threaded bolts, a plurality of washers formed of a non-metallic material, and a plurality of nuts.

Another aspect of the present invention is directed to an antenna mount kit. The antenna mount kit may include an antenna mount and a pipe clamp coupled to the antenna mount. The pipe clamp may include a front shell half and a rear shell half, the front shell half and the rear shall half having a front shell half inner surface and a rear shell half inner surface configured to cooperate with each other such that a support structure can be secured within the pipe clamp. The front shell half inner surface and the rear shell half inner surface may each include a plurality of jagged teeth, at least two front shell bolt apertures through the front shell half and at least two rear shell half bolt apertures through the rear shell half, where the front shell half bolt apertures align with the rear shell half bolt apertures when securing the support structure within the pipe clamp, at least two threaded bolts, a plurality of washers, and a plurality of nuts. The antenna mount kit may be cladded with a non-conductive material.

Another aspect of the present invention is directed to a method for reducing external passive intermodulation from an antenna mount kit. The method may include providing an antenna mount kit as described herein and encapsulating the antenna mount kit with a non-conductive material, thereby reducing the external passive intermodulation of the antenna mount kit.

Another aspect of the present invention is directed to an antenna mount assembly. The antenna mount assembly may include a mounting structure and an antenna mount kit. The antenna mount kit may include an antenna mount and a pipe clamp coupled to the antenna mount. The pipe may include a front shell half and a rear shell half, the front shell half and the rear shall half having a front shell half inner surface and a rear shell half inner surface that cooperate with each other to secure the mounting structure within the pipe clamp. The front shell half inner surface and the rear shell half inner surface may each include a plurality of jagged teeth formed of a non-metallic material, at least two front shell bolt apertures through the front shell half and at least two rear shell half bolt apertures through the rear shell half, where the front shell half bolt apertures align with the rear shell half bolt apertures when securing the mounting structure within the pipe clamp, at least two threaded bolts, a plurality of washers, and a plurality of nuts. The threaded bolts extend through the front and rear shell half bolt apertures and are secured with the plurality of washers and the plurality of nuts to retain the antenna mount kit to the mounting structure.

Another aspect of the present invention is directed to an antenna mount kit. The antenna mount kit may include an antenna mount and a pipe clamp coupled to the antenna mount. The pipe clamp may include a front shell half and a rear shell half, the front shell half and the rear shall half having a front shell half inner surface and a rear shell half inner surface configured to cooperate with each other such that the mounting structure can be secured within the pipe clamp. The front shell half inner surface and the rear shell half inner surface each may include a plurality of jagged teeth formed of a non-metallic material. The pipe clamp may further include at least two front shell bolt apertures through the front shell half and at least two rear shell half bolt apertures through the rear shell half. The front shell half bolt apertures align with the rear shell half bolt apertures when securing the mounting structure within the pipe clamp. The pipe clamp may further include at least two isolation fasteners, each isolation fastener having an annular portion and a retention portion. The pipe clamp may further include at least two threaded bolts, a plurality of washers, and a plurality of nuts.

Another aspect of the present invention is directed to an antenna mount assembly. The antenna mount assembly may include a mounting structure and an antenna mount kit. The antenna mount kit may include an antenna mount and a pipe clamp coupled to the antenna mount. The pipe clamp may include a front shell half and a rear shell half, the front shell half and the rear shall half having a front shell half inner surface and a rear shell half inner surface that cooperate with each other to secure the mounting structure within the pipe clamp. The front shell half inner surface and the rear shell half inner surface each may include a plurality of jagged teeth formed of a non-metallic material. The pipe clamp may further include at least two front shell bolt apertures through the front shell half and at least two rear shell half bolt apertures through the rear shell half. The front shell half bolt apertures align with the rear shell half bolt apertures when securing the mounting structure within the pipe clamp. The pipe clamp may further include at least two isolation fasteners, each isolation fastener having an annular portion and a retention portion. The retention portion of each isolation fastener may include a securing member. The pipe clamp may further include at least two threaded bolts, a plurality of washers, and a plurality of nuts. The annular portion of each isolation fastener may be received by a respective rear shell half bolt aperture and the securing member of the retention portion may engage the rear shell half of the pipe clamp. The threaded bolts may extend through the front and rear shell half bolt apertures and the isolation fasteners and may be secured with the plurality of washers and the plurality of nuts to retain the antenna mount kit to the mounting structure.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim and/or file any new claim accordingly, including the right to be able to amend any originally filed claim to depend from and/or incorporate any feature of any other claim or claims although not originally claimed in that manner. These and other objects and/or aspects of the present invention are explained in detail in the specification set forth below. Further features, advantages and details of the present invention will be appreciated by those of ordinary skill in the art from a reading of the figures and the detailed description of the preferred embodiments that follow, such description being merely illustrative of the present invention.

DETAILED DESCRIPTION

Figure 1:
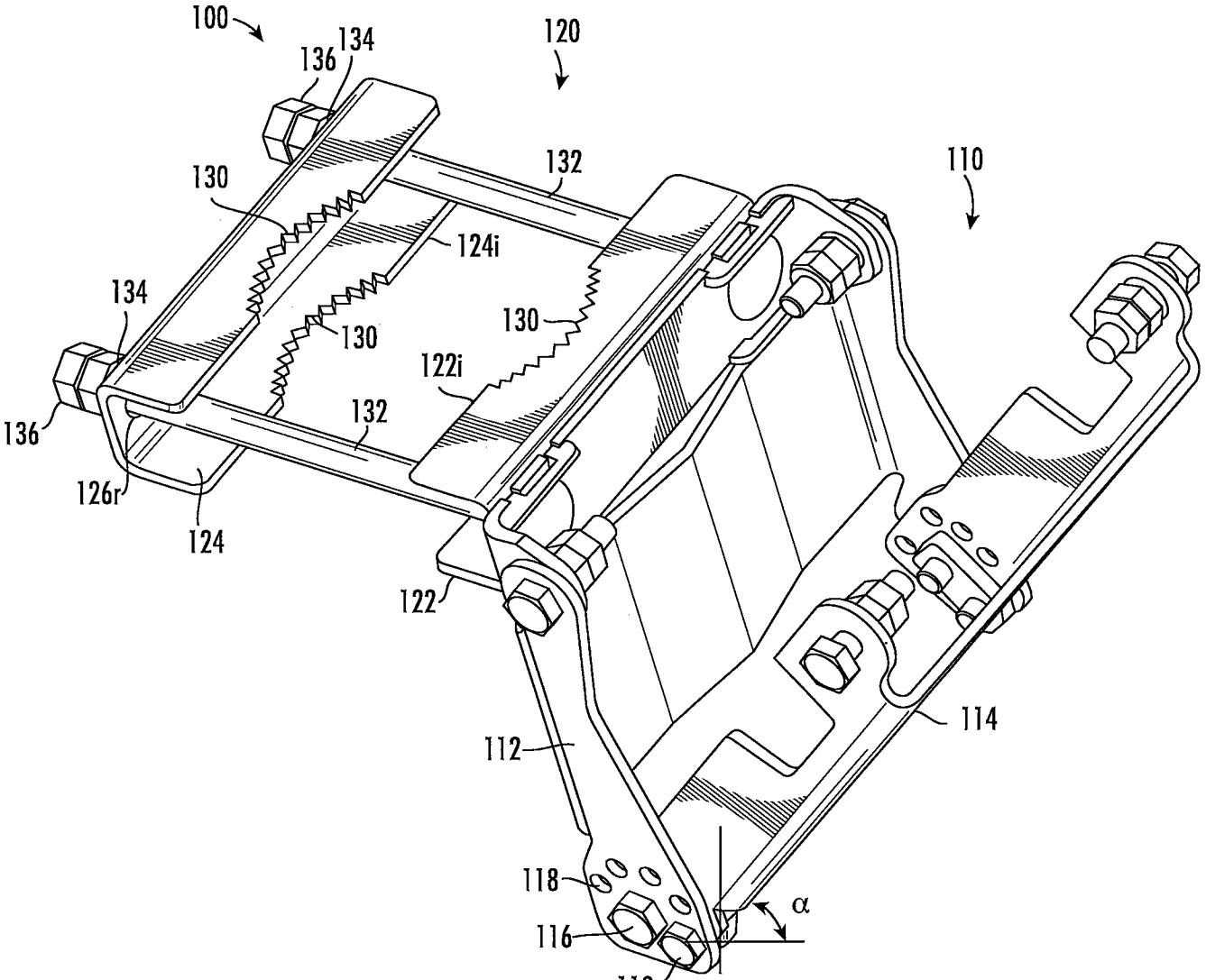
FIG. 1 is a front perspective view of an antenna mount kit according to embodiments of the present invention.

The present invention now is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The present invention now will be described more fully hereinafter with reference to the accompanying drawings, in which illustrative embodiments of the invention are shown. Like numbers refer to like elements throughout and different embodiments of like elements can be designated using a different number of superscript indicator apostrophes (e.g., 10, 10', 10").

In the figures, certain layers, components or features may be exaggerated for clarity, and broken lines illustrate optional features or operations unless specified otherwise. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited, to the order presented in the claims or figures unless specifically indicated otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Embodiments of the present invention are directed to antenna mount kits and assemblies, which may greatly reduce passive intermodulation (PIM) when used near base station antennas and/or tower mounted radio frequency (RF) products by eliminating the metal-to-metal interfaces. In some embodiments, an antenna mount kit may comprise an antenna mount formed of a non-metallic material, such as, for example fiberglass or glass-reinforced resin. In some embodiments, an antenna mount kit may comprise a hybrid design including structural support elements formed of metal and other elements formed of a non-metallic material. In some embodiments, an antenna mount kit may be encapsulated with PIM-friendly coating (e.g., a non-conductive material) via a cladding process, deposition, or painting. In some embodiments, an antenna mount kit may comprise ceramic or non-metallic interfaces, such as, for example, non-metallic washers to reduce metal-to-metal contacts near an antenna.

Figure 2:
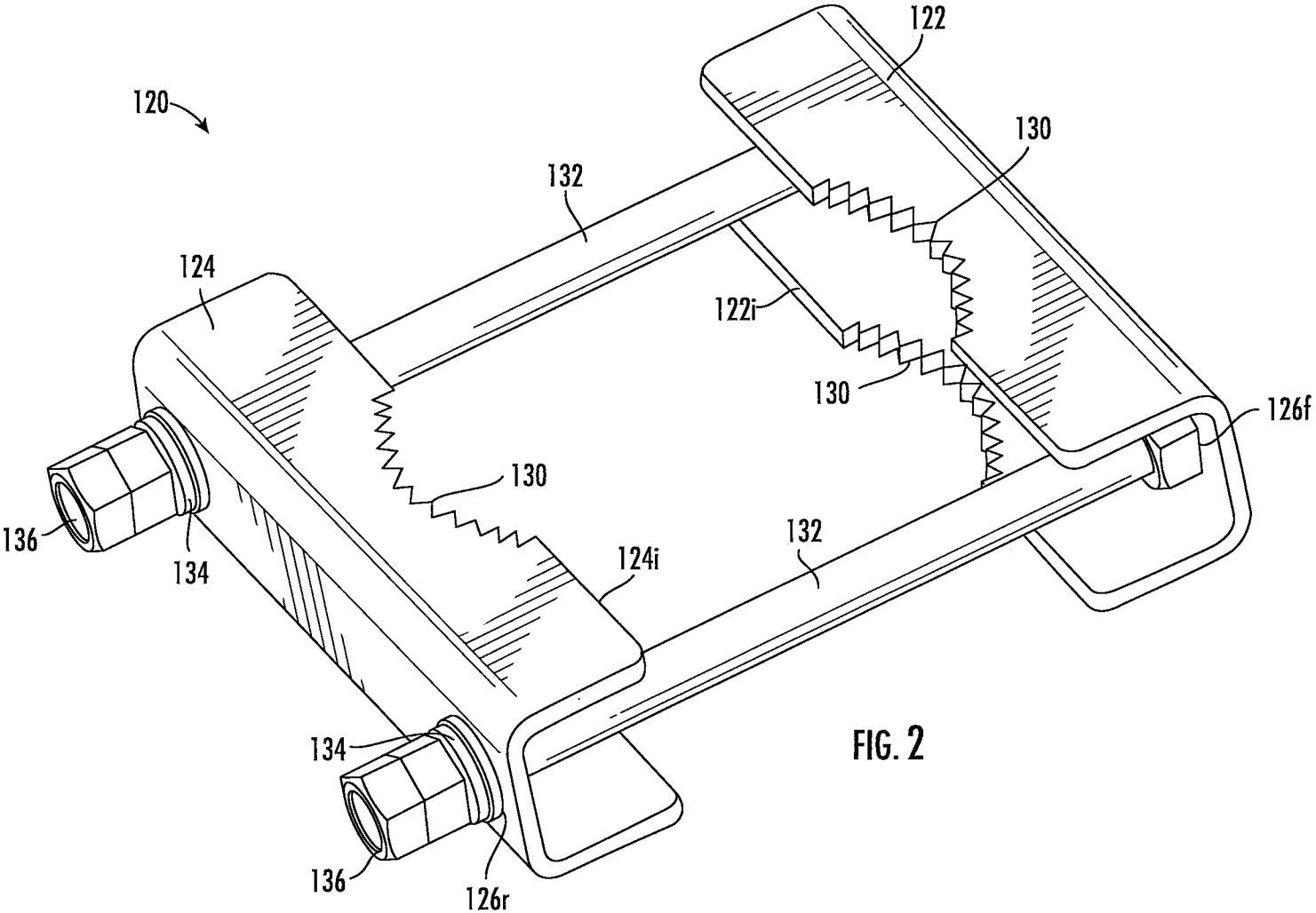
FIG. 2 is a rear perspective view of a pipe clamp of the antenna mount kit of FIG. 1 according to embodiments of the present invention.
Figure 3:
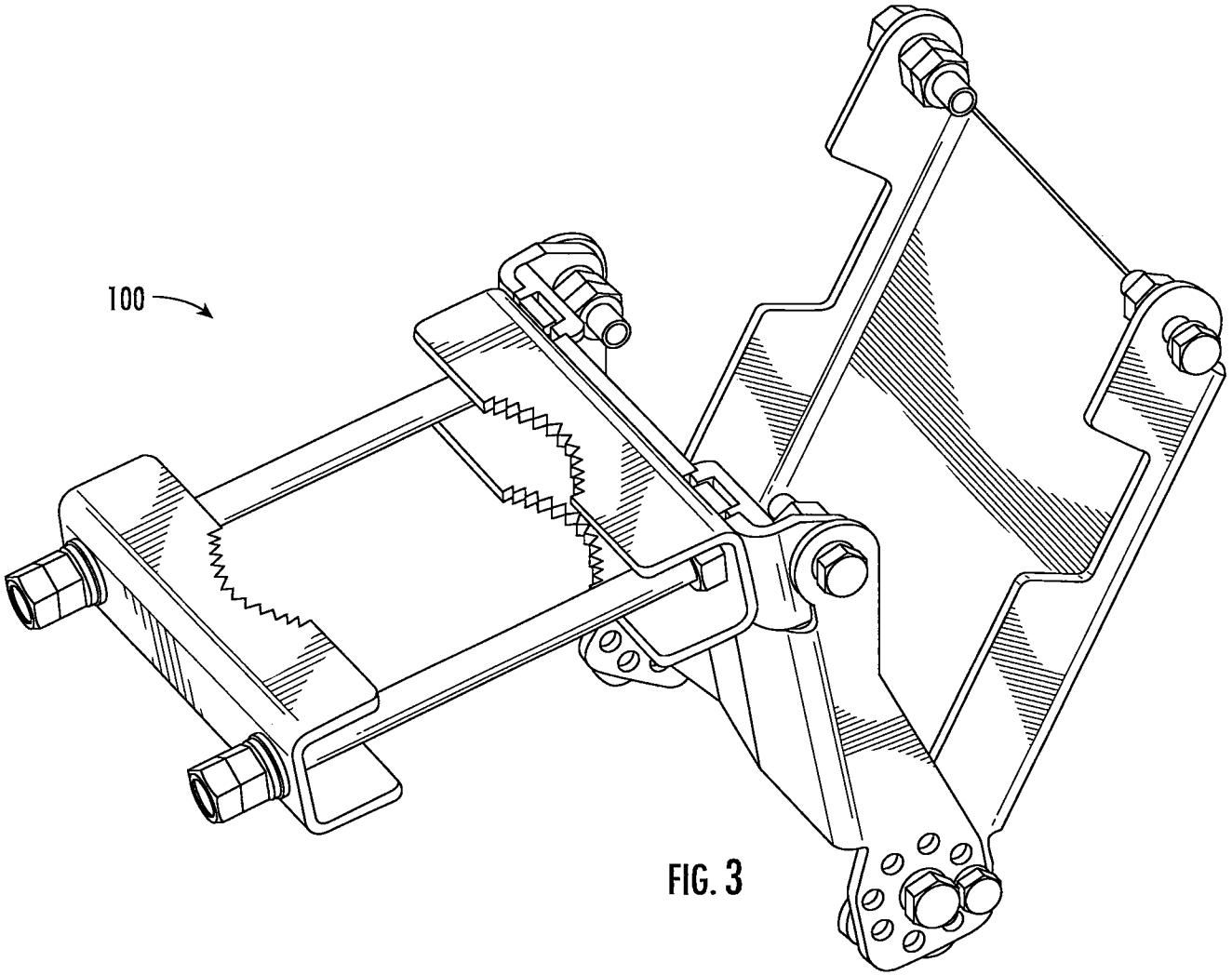
FIG. 3 is a rear perspective view of the antenna mount kit of FIG. 1 encapsulated with a non-conductive material according to embodiments of the present invention.

Referring now to the figures, an antenna mount kit 100 according to some embodiments of the present invention is illustrated in FIGS. 1-3. As shown in FIG. 1, an antenna mount kit 100 comprises an antenna mount 110 and a pipe clamp 120. In some embodiments, the pipe clamp 120 is coupled to the antenna mount 110.

Referring to FIGS. 1-2, in some embodiments, the pipe clamp 120 comprises a front shell half 122 and a rear shell half 124. The front shell half 122 and the rear shall half 124 have a front shell half inner surface **122*i* and a rear shell half inner surface 124*i* configured to cooperate with each other such that a mounting structure 150 (e.g., a telecommunications tower, leg or monopole) can be secured within the pipe clamp 120 (see, e.g., FIG. 4). The front shell half inner surface 122*i* and the rear shell half inner surface 124*i* each comprise a plurality of jagged teeth 130. In some embodiments, the front shell half inner surface 122*i* and the rear shell half inner surface 124*i* may have portions that are concave in shape. The concave inner surfaces 122*i*, 124*i* provide a larger contact area between the pipe clamp 120 and the mounting structure 150, such as, for example, when the mounting structure 150 is cylindrical in shape (see, e.g., FIG. 4**).

In some embodiments, the plurality of jagged teeth 130 is formed of a non-metallic material. In some embodiments, the non-metallic material forming the plurality of jagged teeth 130 may comprise a polymeric material, fiberglass or glass-reinforced resin. For example, in some embodiments, the polymeric material forming the plurality of jagged teeth 130 may comprise nylon, acetal, polypropylene, polyethylene or polytetrafluoroethene (PTFE).

In some embodiments, the antenna mount 110 is formed of a non-metallic material. In some embodiments, the non-metallic material forming the antenna mount 110 may comprise fiberglass or glass-reinforced resin.

Some current methods of securing an antenna to a mounting structure may comprise attaching a metallic bracket or clamp (e.g., a metal pipe clamp) to a metallic mounting structure. The metal-to-metal interface between the clamp and the structure could be a source of unwanted PIM near an antenna. The hybrid design of an antenna mount kit of the present invention may greatly reduce this unwanted PIM by removing the metal-to-metal interface and replacing with a non-metal to metal interface (e.g., non-metallic jagged teeth 130 contacting a metallic mounting structure 150 and/or a non-metallic antenna mount 110 contacting a metallic pipe clamp 120) while maintaining the strength/structural support needed to secure an antenna to a mounting structure.

The antenna mount kit 100 of the present invention may comprise a variety of different antenna mounts. For example, as shown in FIG. 1, in some embodiments, the antenna mount 110 may comprise a first mounting bracket 112 configured to be mounted to the pipe clamp 120 and a second mounting bracket 114 configured to be mounted to an antenna (not shown). In some embodiments, the first mounting bracket 112 and second mounting bracket 114 may be pivotally coupled at a pivot 116. In some embodiments, the pivot 116 may comprise equally spaced apart phase holes 118 configured to receive an adjustment bolt 119. In some embodiments, the spacing between each phase hole 118 is equivalent to about a 1 degree to about a 1.5 degree adjustment in the angle (a) of tilt of the antenna.

Still referring to FIGS. 1-2, the pipe clamp 120 further comprises at least two front shell bolt apertures **126*f* through the front shell half 122 and at least two rear shell half bolt apertures 126*r* through the rear shell half 124. The front shell half bolt apertures 126*f* align with the rear shell half bolt apertures 126*r* when securing the mounting structure 150 within the pipe clamp 120 (see, e.g., FIG. 4**).

In some embodiments, the pipe clamp 120 comprises at least two threaded bolts 132, a plurality of washers 134, and a plurality of nuts 136. The threaded bolts 132 may extend through the front and rear shell half bolt apertures 126*f*, 126*r* and be secured with the plurality of washers 134 and plurality of nuts 136, thereby securing a mounting structure 150 within the pipe clamp 120 (see, e.g., FIG. 4).

In some embodiments, the threaded bolts 132, the plurality of washers 134, and/or the plurality of nuts 136 are formed of a ceramic, fiber glass, or non-metallic material. In some embodiments, the non-metallic material forming the threaded bolts 132, the plurality of washers 134, and/or the plurality of nuts 136 may comprise a polymeric material. For example, in some embodiments, the polymeric material forming the threaded bolts 132, the plurality of washers 134, and/or the plurality of nuts 136 may comprise nylon, acetal, polypropylene, polyethylene or polytetrafluoroethene (PTFE).

Common methods of securing an antenna to a mounting structure comprise using metallic bolts, washers, and/or nuts to attach the metallic clamp or bracket to the metallic mounting structure. Like discussed above, the metal-to-metal interfaces between the metallic bolts, washers, nuts, clamps and/or mounting structure all could be a source of unwanted PIM near an antenna. An antenna mount kit of the present invention may greatly reduce this unwanted PIM by removing the metal-to-metal interface and replacing with a non-metal to metal or non-metal to non-metal interface (e.g., using non-metallic bolts, washers and/or nuts).

In some embodiments, the use of non-metallic materials may require structural and/or design changes to be made to increase the structural integrity of the antenna mount 110 and/or pipe clamp 120. Exemplary structural and/or design changes that could be made include, but are not limited to, increasing the thickness of the front and/or rear shell halves 122, 124 and adding a rigidizing feature, such as, ribs to weaker sections of the antenna mount 110 or pipe clamp 120.

As shown in FIG. 3, in some embodiments, the antenna mount kit 100 may be cladded, painted or deposited with a non-conductive material. For example, in some embodiments, the antenna mount kit 100 is cladded with a glass reinforced resin, polyurethane or urethane coating, powder coating, or paint. As discussed above, the metal-to-metal interface between the pipe clamp 120 and a mounting structure 150 could be a source of unwanted PIM near an antenna. Coating the antenna mount kit 100 with a non-conductive material eliminates this metal-to-metal interface. Thus, the antenna mount kit 100 of the present invention may greatly reduce unwanted PIM.

Figure 4:
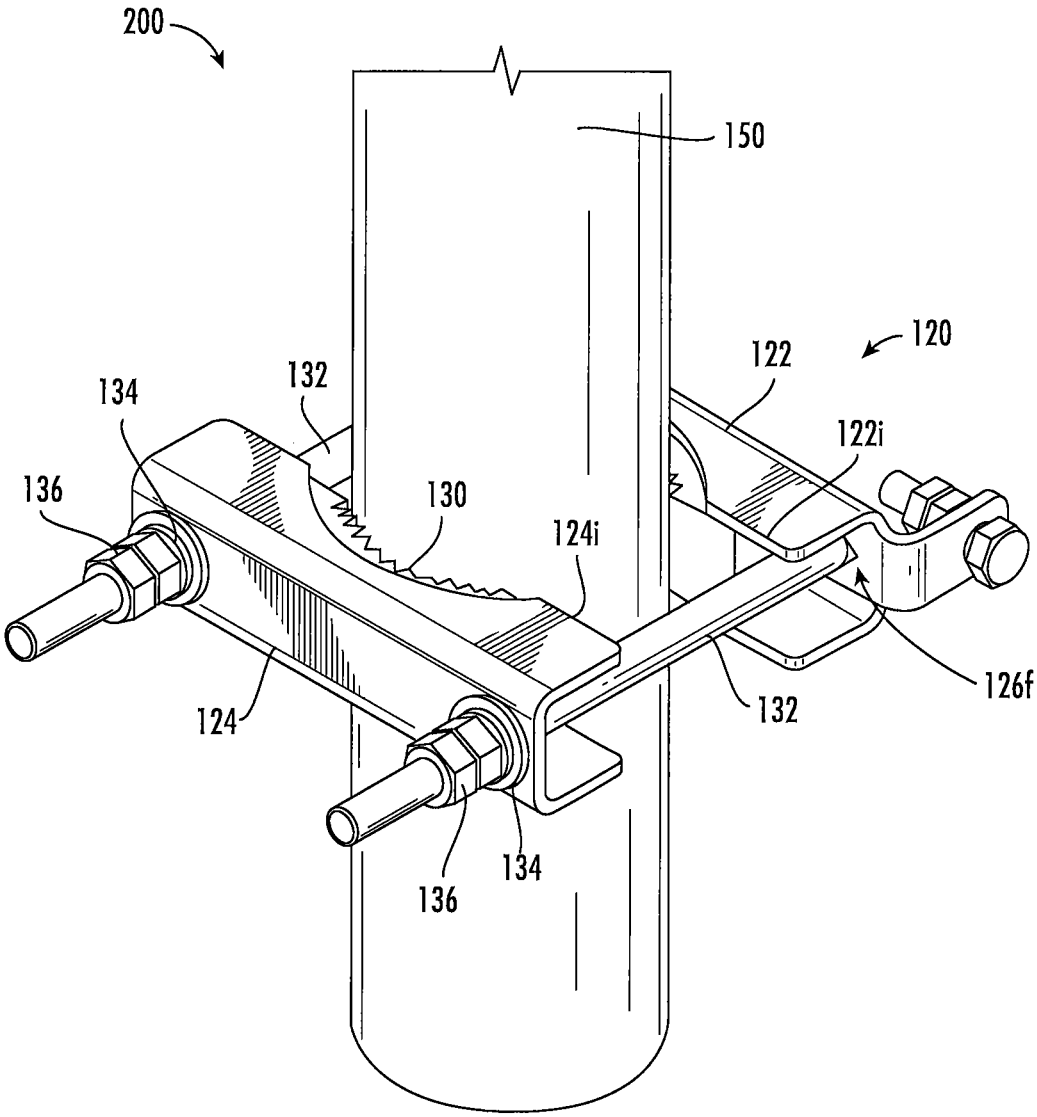
FIG. 4 is a rear perspective view of an antenna mount kit assembly according to embodiments of the present invention.

Referring now to FIG. 4, an antenna mount assembly 200 according to some embodiments of the present invention is illustrated. In some embodiments, the antenna mount assembly 200 comprises a mounting structure 150 and an antenna mount kit 100. The antenna mount kit 120 is similar to those previously described herein comprising an antenna mount 110 and a pipe clamp 120 coupled to the antenna mount 110. The threaded bolts 132 of the pipe clamp 120 extend through the front and rear shell half bolt apertures 126*f*, 126*r* and are secured with the plurality of washers 134 and the plurality of nuts 136 to retain the antenna mount kit 120 to the mounting structure 150. In some embodiments, the mounting structure 150 is a telecommunications tower.

Currently, some antenna mounts use metal carriage bolts (e.g., galvanized steel) and metal clamp brackets (e.g., zinc-plated steel) to secure an antenna to a pole. During installation, the galvanized steel carriage bolt can make contact with the zinc-plated steel clamp bracket. As discussed above, this intermittent metal-to-metal contact can create unwanted PIM. According to some embodiments of the present invention, an isolation fastener 170, 170' may be placed between the bolt and clearance hole in the clamp bracket to help prevent this undesirable metal-to-metal contact.

Exemplary isolation fasteners 170, 170' according to embodiments of the present invention are illustrated in FIGS. 5A-7. The isolation fasteners 170, 170' may be used with the antenna mount kits 100 and antenna mount assemblies 200 described above or may be used with prior existing antenna mounts.

Figure 5A:
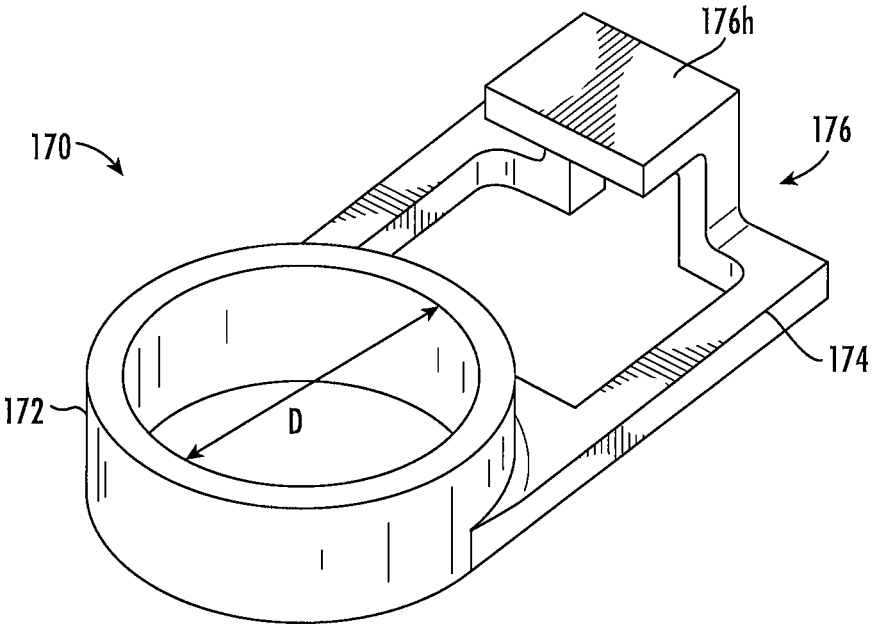
FIG. 5A is a perspective view of an isolation fastener according to embodiments of the present invention.
Figure 5B:
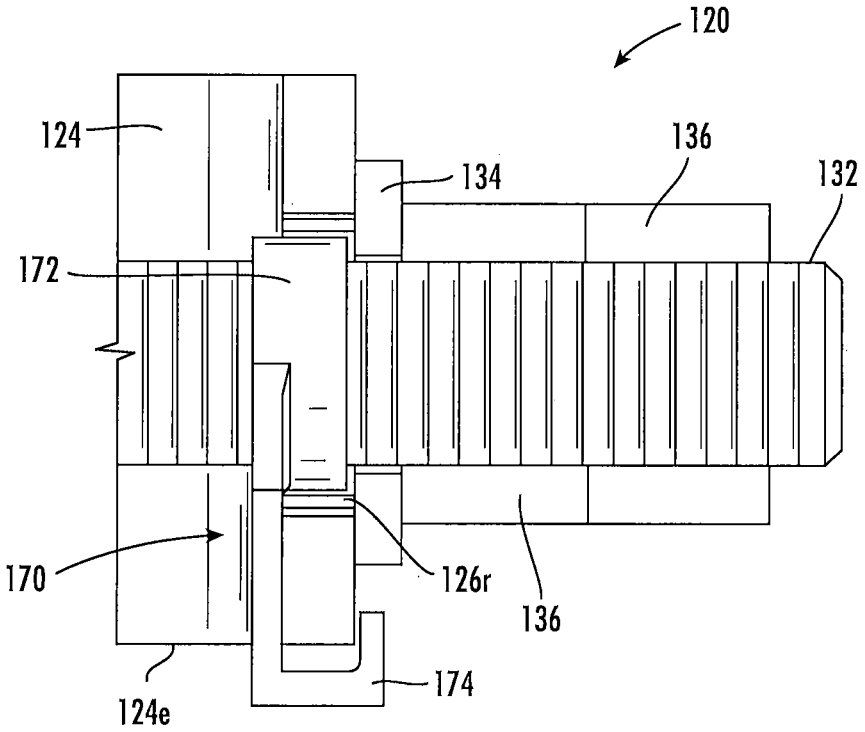
FIG. 5B is a cross-sectional side view of the isolation fastener of FIG. 5A installed around a threaded bolt of the antenna mount kit of FIG. 1.

Referring to FIGS. 5A and 5B, an isolation fastener 170 according to embodiments of the present invention is shown. As shown in FIG. 5A, the isolation fastener 170 has an annular portion 172 and a retention portion 174. The annular portion 172 has a diameter (D) small enough such that the annular portion 172 may be received in the rear shell half bolt aperture 126*r*, but large enough to allow a threaded bolt 132 to extend therethrough. The diameter (D) of the annular portion 172 may be adjusted such that the isolation fastener may be used with any diameter bolt 132. In some embodiments, the annular portion 172 of the isolation fastener 170 has a diameter (D) in the range of about 0.25 inches to about 1 inch.

In some embodiments, the retention portion 174 further comprises a securing member 176. The securing member 176 is configured to engage and hold the isolation fastener 170 to the pipe clamp 120. For example, in some embodiments, the securing member 176 is a hook 176*h*. The hook 176*h* may be configured to engage the rear shell half 124 of the pipe clamp 120, thereby retaining the isolation fastener 170 in the rear shell half bolt aperture 126*r* as a threaded bolt 132 is being inserted.

As shown in FIG. 5B, the annular portion 172 of the isolation fastener 170 is received by a respective rear shell half bolt aperture 126*r* and the securing member 176 (e.g., hook 176*h*) of the retention portion 174 engages an outer edge 124*e* of the rear shell half 124 of the pipe clamp 120. The threaded bolt 132 extends through rear shell half bolt apertures 126*r* and the annular portion 172 of the isolation fastener 170. The threaded bolt 132 is secured with the washer 134 and the plurality of nuts 136 to retain an antenna mount kit 100 to the mounting structure 150. As shown in FIG. 5B, the isolation fastener 170 is installed between the threaded bolt 132 and the pipe clamp 120, preventing the threaded bolt 132 from making contact with the pipe clamp 120. Thus, the isolation fastener 170 helps to mitigate or eliminate unwanted PIM created by the potential metal-to-metal contact of the threaded bolt 132 and the pipe clamp 120.

Figure 6A:
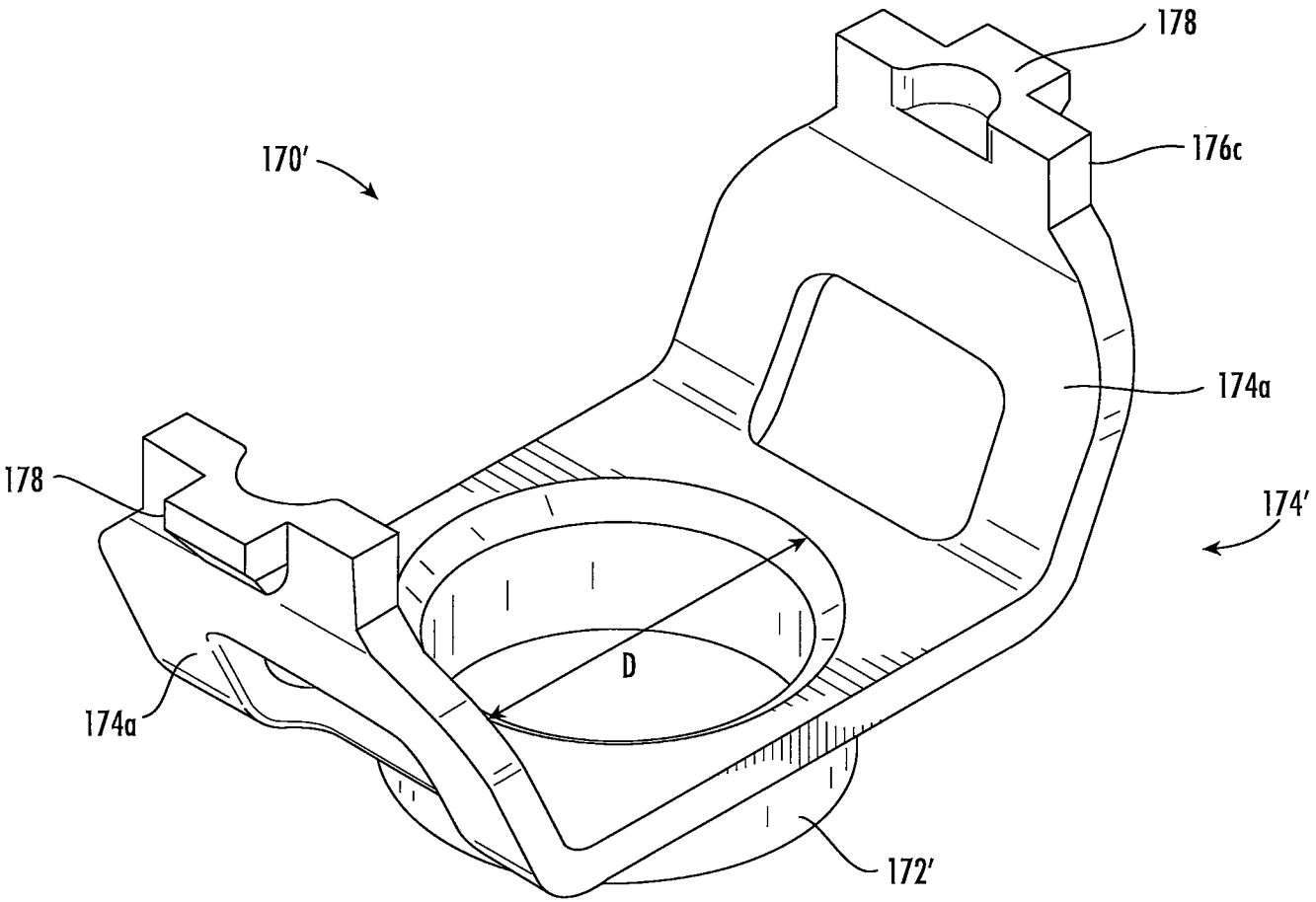
FIG. 6A is a perspective view of another isolation fastener according to embodiments of the present invention.
Figure 6B:
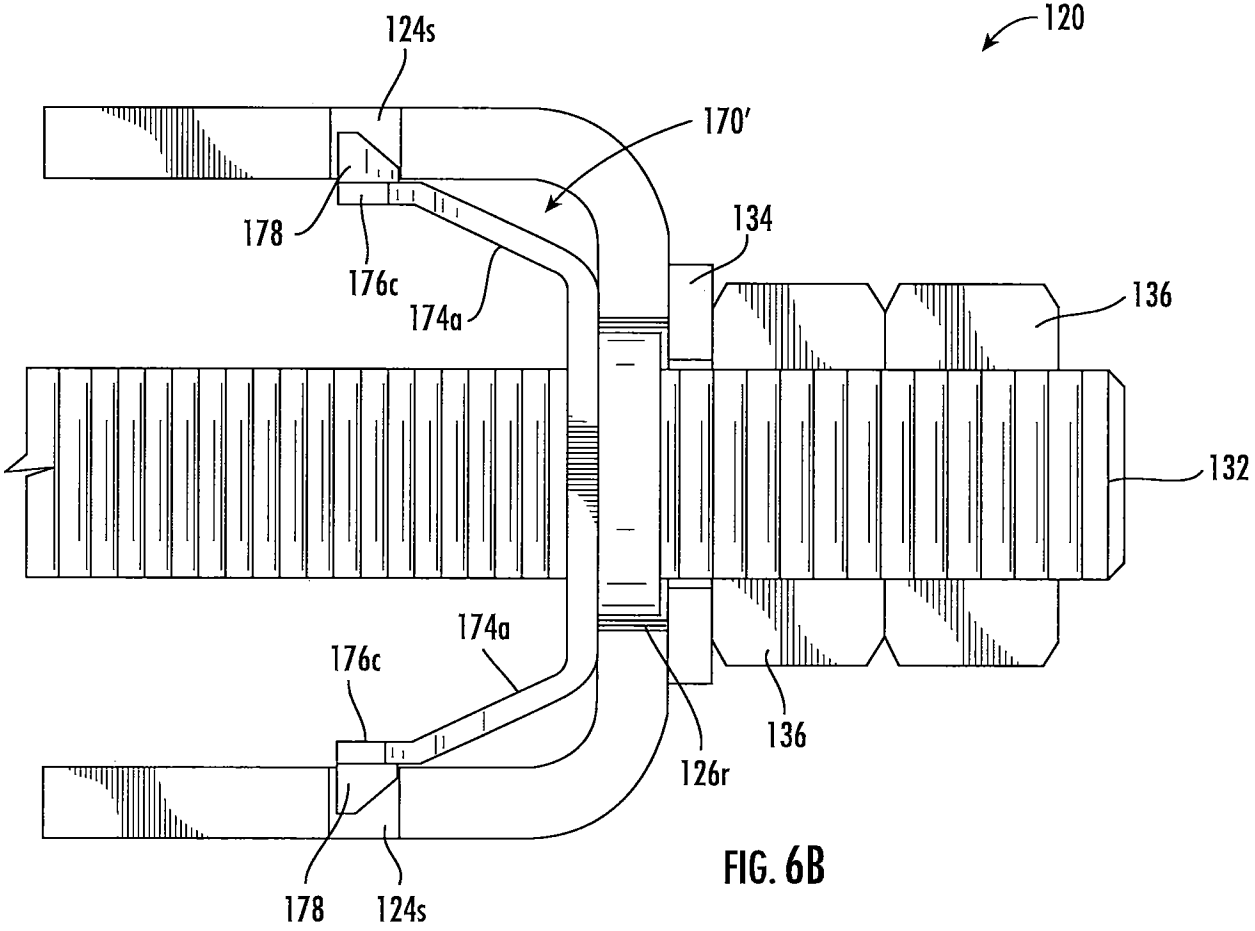
FIG. 6B is a cross-sectional side view of the isolation fastener of FIG. 6A installed around a threaded bolt of the antenna mount kit of FIG. 1.
Figure 6C:
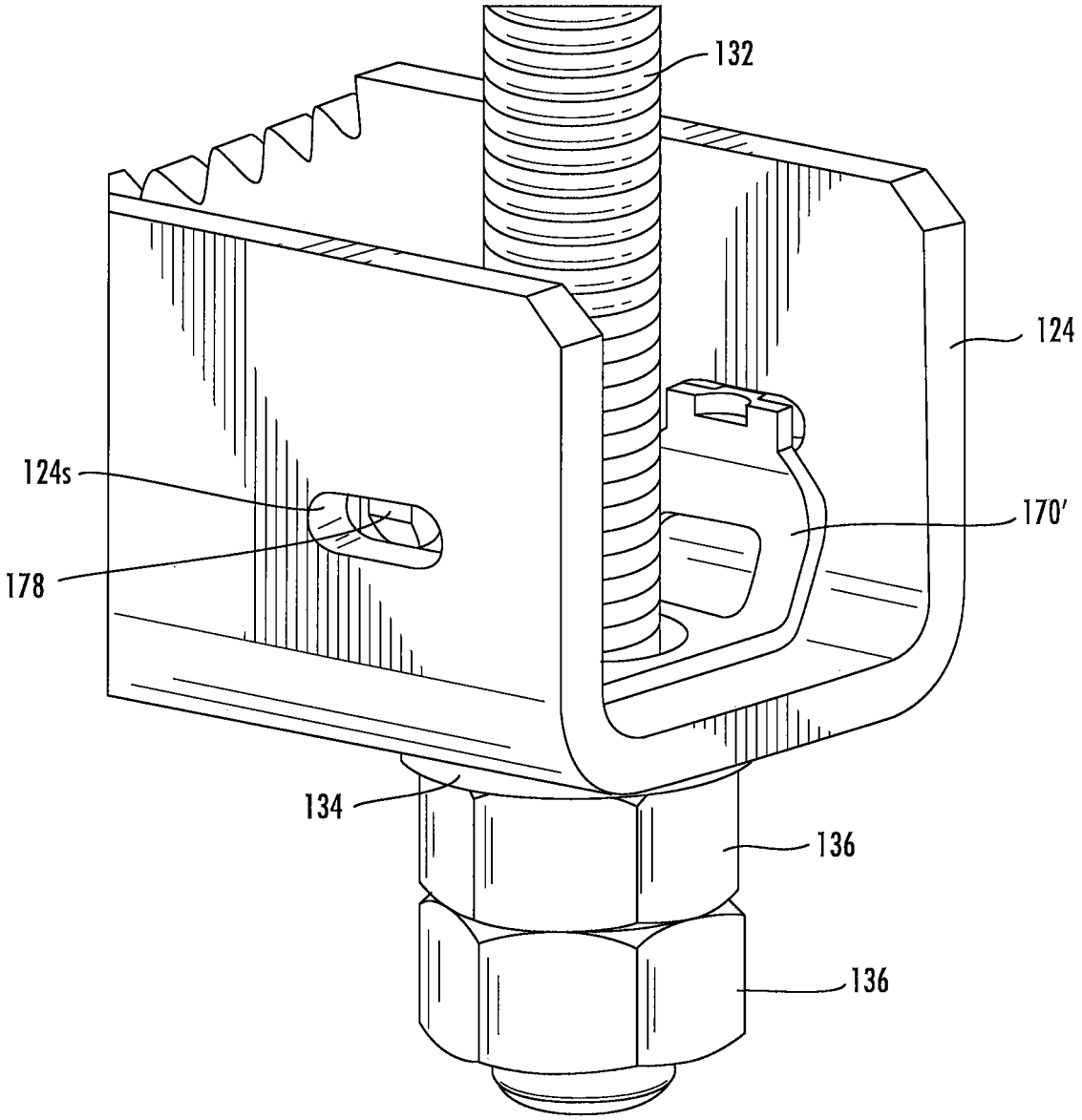
FIG. 6C is a perspective view of the isolation fastener installed around a threaded bolt as shown in FIG. 6B.

Referring now to FIGS. 6A-6C, another isolation fastener 170' according to embodiments of the present invention is illustrated. Like the isolation fastener 170, the annular portion 172' of isolation fastener 170' has a diameter (D) small enough such that the annular portion 172' may be received in the rear shell half bolt aperture 126*r*, but large enough to allow a threaded bolt 132 to extend therethrough. However, as shown in FIGS. 6A-6C, the isolation fastener 170' has a different retention portion 174' than the isolation fastener 170 describe above.

As shown in FIG. 6A, the retention portion 174' of the isolation fastener 170' comprises two opposing radially and axially extending arms 174*a*. The securing member 176' resides at the end of each radially extending arm 174*a*. In some embodiments, the securing member 176' may comprise one or more snap-clips 176*c*. The snap-claps 176*c* are configured to engage the rear shell half 124 of the pipe clamp 120. For example, in some embodiments, the snap-claps 176*c* may comprise a protrusion 178 that is configured to engage a slot 124*s* in the rear shell half 124 of the pipe clamp 120 (see, e.g., FIGS. 6B and 6C). The radially extending arms 174*a* of the retention portion 174' have sufficient flexibility to allow the protrusions 178 of the snap-claps 176*c* to engage the slots 124*s* in the rear shell half 124.

As shown in FIGS. 6B and 6C, the annular portion 172' of the isolation fastener 170' is received by a respective rear shell half bolt aperture 126*r* and the securing member 176' (e.g., the protrusions 178 of the snap-clips 176*c*) engages the slot 124*s* in the rear shell half 124 of the pipe clamp 120. The threaded bolt 132 extends through rear shell half bolt apertures 126*r* and the annular portion 172' of the isolation fastener 170'. The threaded bolt 132 is secured with the washer 134 and the plurality of nuts 136 to retain an antenna mount kit 100 to the mounting structure 150. As shown in FIG. 6B, the isolation fastener 170' is installed between the threaded bolt 132 and the pipe clamp 120, preventing the threaded bolt 132 from making contact with the pipe clamp 120. Thus, the isolation fastener 170' helps to mitigate or eliminate unwanted PIM created by the potential metal-to-metal contact of the threaded bolt 132 and the pipe clamp 120.

In order to prevent metal-to-metal contact, the isolation fasteners 170, 170' of the present invention are formed from a polymeric material. For example, in some embodiments, the isolation fasteners 170, 170' comprise acrylonitrile styrene acrylate (ASA). In some embodiments, the isolation fasteners 170, 170' are formed by injection molding.

Figure 7:
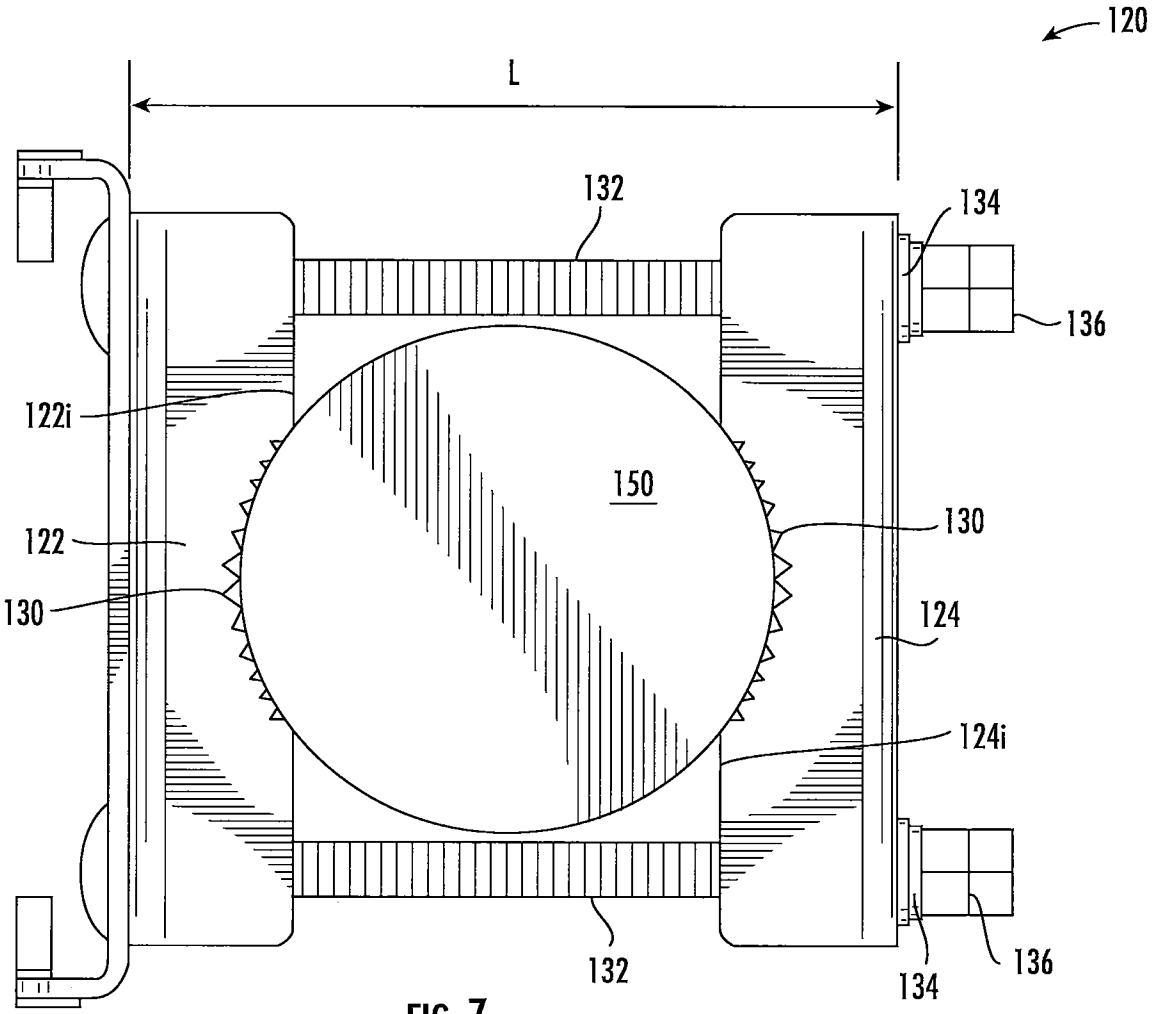
FIG. 7 is a top view of a pipe clamp according to embodiments of the present invention.

The isolation fasteners 170, 170' are adaptable for engagement with threaded bolts 132 having different threads lengths. As shown in FIG. 7, as the diameter of a mounting structure 150 (e.g., a pole) changes, the grip length (L) of the pipe clamp 120 changes. Since the isolation fasteners 170, 170' (hidden in FIG. 7) are retained to the pipe clamp 120 (e.g., by the securing member 176, 176'), the isolation fasteners 170, 170' will help prevent the threaded bolt 132 from making contact with the pipe clamp 120 when inserted through the rear shell half bolt apertures 126*r*.

Methods for reducing external passive intermodulation from an antenna mount kit are also provided. In some embodiments, a method for reducing external passive intermodulation from an antenna mount kit comprises providing an antenna mount kit as described herein; and encapsulating the antenna mount kit with a non-conductive material, thereby reducing the external passive intermodulation of the antenna mount kit. Exemplary types of non-conductive materials that may be used included, but are not limited to, glass reinforced resins, polyurethane or urethane coatings (e.g., LINE-X® coatings (LINE-X LLC, Huntsville, Ala.)), powder coatings, or paints.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. An antenna mount kit, comprising:

an antenna mount; and a pipe clamp coupled to the antenna mount, the pipe clamp comprising:

a front shell half and a rear shell half, the front shell half and the rear shall half having a front shell half inner surface and a rear shell half inner surface configured to cooperate with each other such that the mounting structure can be secured within the pipe clamp, wherein the front shell half inner surface and the rear shell half inner surface each comprise a plurality of jagged teeth formed of a non-metallic material;

at least two front shell bolt apertures through the front shell half and at least two rear shell bolt apertures through the rear shell half, wherein the front shell half bolt apertures align with the rear shell half bolt apertures when securing the mounting structure within the pipe clamp;

at least two isolation fasteners, each isolation fastener having an annular portion and a retention portion, wherein at least a portion of the annular portion of the isolation fasteners is configured to be received by and extend into a respective front and/or rear shell half bolt aperture;

at least two threaded bolts;

a plurality of washers; and a plurality of nuts.

2. The antenna mount kit of claim 1, wherein the annular portion of each isolation fastener is configured to be received by a respective rear shell half bolt aperture and each of the at least two threaded bolts extend through the annular portion of a respective isolation fastener.

3. The antenna mount kit of claim 1, wherein the retention portion comprises a securing member configured to engage the isolation fastener to the pipe clamp.

4. The antenna mount kit of claim 3, wherein the securing member comprises one or more protrusions configured to engage a slot in the rear shell half of the pipe clamp.

5. The antenna mount kit of claim 3, wherein the securing member comprises a hook configured to engage an outer edge of the rear shell half of the pipe clamp.

6. The antenna mount kit of claim 1, wherein the at least two isolation fasteners are formed of a polymeric material.

7. An antenna mount kit, comprising:

an antenna mount; and a pipe clamp coupled to the antenna mount, the pipe clamp comprising:

a front shell half and a rear shell half, the front shell half and the rear shall half having a front shell half inner surface and a rear shell half inner surface configured to cooperate with each other such that the mounting structure can be secured within the pipe clamp, wherein the front shell half inner surface and the rear shell half inner surface each comprise a plurality of jagged teeth;

at least two front shell bolt apertures through the front shell half and at least two rear shell bolt apertures through the rear shell half, wherein the front shell half bolt apertures align with the rear shell half bolt apertures when securing the mounting structure within the pipe clamp;

at least two isolation fasteners, each isolation fastener having an annular portion and a retention portion, wherein at least a portion of the annular portion of the isolation fasteners is configured to be received by and extend into a respective front and/or rear shell half bolt aperture;

at least two threaded bolts;

a plurality of washers; and a plurality of nuts.

8. The antenna mount kit of claim 7, wherein the retention portion comprises a securing member configured to engage the isolation fastener to the pipe clamp.

9. The antenna mount kit of claim 8, wherein the securing member comprises one or more protrusions configured to engage a slot in the rear shell half of the pipe clamp.

10. The antenna mount kit of claim 8, wherein the securing member comprises a hook configured to engage an outer edge of the rear shell half of the pipe clamp.

11. The antenna mount kit of claim 7, wherein the at least two isolation fasteners are formed of a polymeric material.

* * * * *